US009230441B2

(12) United States Patent
Sung et al.

(10) Patent No.: US 9,230,441 B2
(45) Date of Patent: Jan. 5, 2016

(54) APPARATUS FOR GATHERING SURROUNDINGS INFORMATION OF VEHICLE

(71) Applicant: Electronics and Telecommunications Research Institute, Daejeon (KR)

(72) Inventors: Kyung Bok Sung, Daejeon (KR); Hyun Kyun Choi, Daejeon (KR); Dong Yong Kwak, Daejeon (KR)

(73) Assignee: Electronics and Telecommunications Research Institute, Daejeon (KR)

( * ) Notice: Subject to any disclaimer, the term of this patent is extended or adjusted under 35 U.S.C. 154(b) by 207 days.

(21) Appl. No.: 13/891,546

(22) Filed: May 10, 2013

(65) Prior Publication Data

US 2014/0070960 A1 Mar. 13, 2014

(30) Foreign Application Priority Data

Sep. 7, 2012 (KR) ..... 10-2012-0099207

(51) Int. Cl.
*G08G 1/16* (2006.01)
*G08G 1/09* (2006.01)
*G08G 1/0967* (2006.01)

(52) U.S. Cl.
CPC ..... *G08G 1/16* (2013.01); *G08G 1/096716* (2013.01); *G08G 1/096725* (2013.01); *G08G 1/096741* (2013.01); *G08G 1/096775* (2013.01); *G08G 1/096783* (2013.01); *G08G 1/096791* (2013.01); *G08G 1/166* (2013.01)

(58) Field of Classification Search
None
See application file for complete search history.

(56) References Cited

U.S. PATENT DOCUMENTS

| | | | | |
|---|---|---|---|---|
| 6,396,417 | B2 * | 5/2002 | Lee | 340/904 |
| 8,095,276 | B2 | 1/2012 | Kozyreff et al. | |
| 8,761,991 | B1 * | 6/2014 | Ferguson et al. | 701/28 |
| 2007/0142037 | A1 * | 6/2007 | O'Toole et al. | 455/414.1 |
| 2008/0114531 | A1 * | 5/2008 | Kagawa | 701/119 |
| 2008/0147267 | A1 * | 6/2008 | Plante et al. | 701/35 |
| 2008/0162036 | A1 * | 7/2008 | Breed | 701/207 |
| 2010/0004839 | A1 * | 1/2010 | Yokoyama et al. | 701/70 |
| 2010/0030540 | A1 * | 2/2010 | Choi et al. | 703/8 |
| 2010/0324775 | A1 * | 12/2010 | Kermani et al. | 701/33 |
| 2011/0098916 | A1 * | 4/2011 | Jang | 701/201 |
| 2011/0102194 | A1 * | 5/2011 | Kinoshita | 340/905 |
| 2011/0153119 | A1 * | 6/2011 | Lee et al. | 701/2 |
| 2012/0095646 | A1 * | 4/2012 | Ghazarian | 701/36 |

(Continued)

FOREIGN PATENT DOCUMENTS

| | | |
|---|---|---|
| KR | 10-0335906 | 5/2002 |
| KR | 10-2004-0083763 B1 | 11/2010 |

(Continued)

*Primary Examiner* — Calvin Cheung
*Assistant Examiner* — Kevin P Mahne
(74) *Attorney, Agent, or Firm* — Nelson Mullins Riley & Scarborough LLP

(57) ABSTRACT

An apparatus for gathering information about surroundings of a vehicle includes: a vehicle sensor data gathering block configured to gather first information about surroundings of the vehicle from one or more sensors mounted on the vehicle; a roadside equipment data gathering block configured to gather second information about surroundings of the vehicle from a roadside communication device installed on a driving infrastructure; and a data integration block configured to classify the first information about surroundings and the second information about surroundings for predefined data types and integrate and manage the classified information about surroundings based on a preset reliability criterion.

12 Claims, 2 Drawing Sheets

(56) References Cited

U.S. PATENT DOCUMENTS

| | | | | |
|---|---|---|---|---|
| 2012/0150428 | A1* | 6/2012 | Niem et al. | 701/409 |
| 2012/0288191 | A1* | 11/2012 | Kido | 382/165 |
| 2012/0294484 | A1* | 11/2012 | Kishida | 382/103 |
| 2012/0294485 | A1* | 11/2012 | Kasaoki | 382/103 |
| 2013/0187792 | A1* | 7/2013 | Egly | 340/901 |
| 2013/0194108 | A1* | 8/2013 | Lapiotis et al. | 340/905 |
| 2013/0304279 | A1* | 11/2013 | Mudalige et al. | 701/2 |
| 2014/0002651 | A1* | 1/2014 | Plante | 348/148 |
| 2014/0009307 | A1* | 1/2014 | Bowers et al. | 340/901 |

FOREIGN PATENT DOCUMENTS

| | | | |
|---|---|---|---|
| KR | 10-2006-0084289 | B1 | 12/2011 |
| KR | 10-2012-0046645 | | 5/2012 |

* cited by examiner

APPARATUS FOR GATHERING SURROUNDINGS INFORMATION OF VEHICLE

RELATED APPLICATIONS(S)

This application claims the benefit of Korean Patent Application No. 10-2012-0099207, filed on Sep. 7, 2012, which is hereby incorporated by references as if fully set forth herein.

FIELD OF THE INVENTION

The present invention relates to an apparatus for gathering information about the surroundings of a vehicle, and more particularly, to an apparatus for gathering information about the surroundings of a vehicle through sensors mounted on the vehicle and a roadside communication device or central communication device and integrating and managing the gathered information about surroundings.

BACKGROUND OF THE INVENTION

As is well known, the development of an autonomous vehicle as well as an advanced drive assistance system (ADAS) has been actively conducted. For the development, information about the environment around a vehicle is fundamentally required. The information about the environment around a vehicle may include information on distances from the vehicle to surrounding vehicles, information on traffic lights of nearby intersections, road information and the like.

Currently, in order to gather information about the surroundings (environment) of a vehicle, a method of gathering information about the surroundings of a vehicle using a laser scanner and an image sensor mounted on the vehicle is used. Such a method is usually utilized when an autonomous vehicle is developed.

Patent Document 1: Korean Patent Laid-open Publication No. 2001-0111141 (published on Dec. 17, 2001)

In the conventional method, however, the sensor may be influenced by the state of the surroundings of the vehicle. Therefore, the reliability of gathered information may be degraded. For example, since the image sensor may be influenced by the position of the sun, required information may be not gathered.

Furthermore, when a sensor is covered by foreign matter or obstacles, information cannot be gathered. For example, when foreign matter adheres to the front surface of the laser scanner, the laser scanner may output an abnormal sensing result. Furthermore, when information on a traffic light at an intersection is intended to be gathered through the image sensor, the traffic light may be blocked by a tall vehicle such as a bus or truck. In this case, it is impossible to gather signal information through the image sensor.

SUMMARY OF THE INVENTION

In accordance with a first aspect of the present invention, there is provided an apparatus for gathering information about the surroundings of a vehicle, including: a vehicle sensor data gathering block configured to gather first information about the surroundings of the vehicle from one or more sensors mounted on the vehicle; a roadside equipment data gathering block configured to gather second information about the surroundings of the vehicle from a roadside communication device installed on a driving infrastructure; and a data integration block configured to classify the first information about surroundings and the second information about surroundings for predefined data types and integrate and manage the classified information about surroundings based on a preset reliability criterion.

In accordance with a second aspect of the present invention, there is provided an apparatus for gathering information about the surroundings of a vehicle, including: a vehicle sensor data gathering block configured to gather first information about surroundings of the vehicle from one or more sensors mounted on the vehicle; a central communication data gathering block configured to gather second information about surroundings of the vehicle from a remote central communication device through wireless communication; and a data integration block configured to classify the first information about surroundings and the second information about surroundings for predefined data types, and integrate and manage the classified information about surroundings based on a preset reliability criterion.

In accordance with a third aspect of the present invention, there is provided an apparatus for gathering information about the surroundings of a vehicle, including: a vehicle sensor data gathering block, configured to gather first information about surroundings of the vehicle from one or more sensors mounted on the vehicle; a roadside equipment data gathering block, configured to gather second information about surroundings of the vehicle from a roadside communication device installed on a driving infrastructure; a central communication data gathering block, configured to gather third information about surroundings of the vehicle from a remote central communication device through wireless communication; and a data integration block, configured to classify the first information about surroundings, the second information about surroundings, and the third information about surroundings for predefined data types, and integrate and manage the classified information about surroundings based on a preset reliability criterion.

BRIEF DESCRIPTION OF THE DRAWINGS

The objects and features of the present invention will become apparent from the following description of embodiments given in conjunction with the accompanying drawings, in which.

DETAILED DESCRIPTION OF THE EMBODIMENTS

Figure 1:
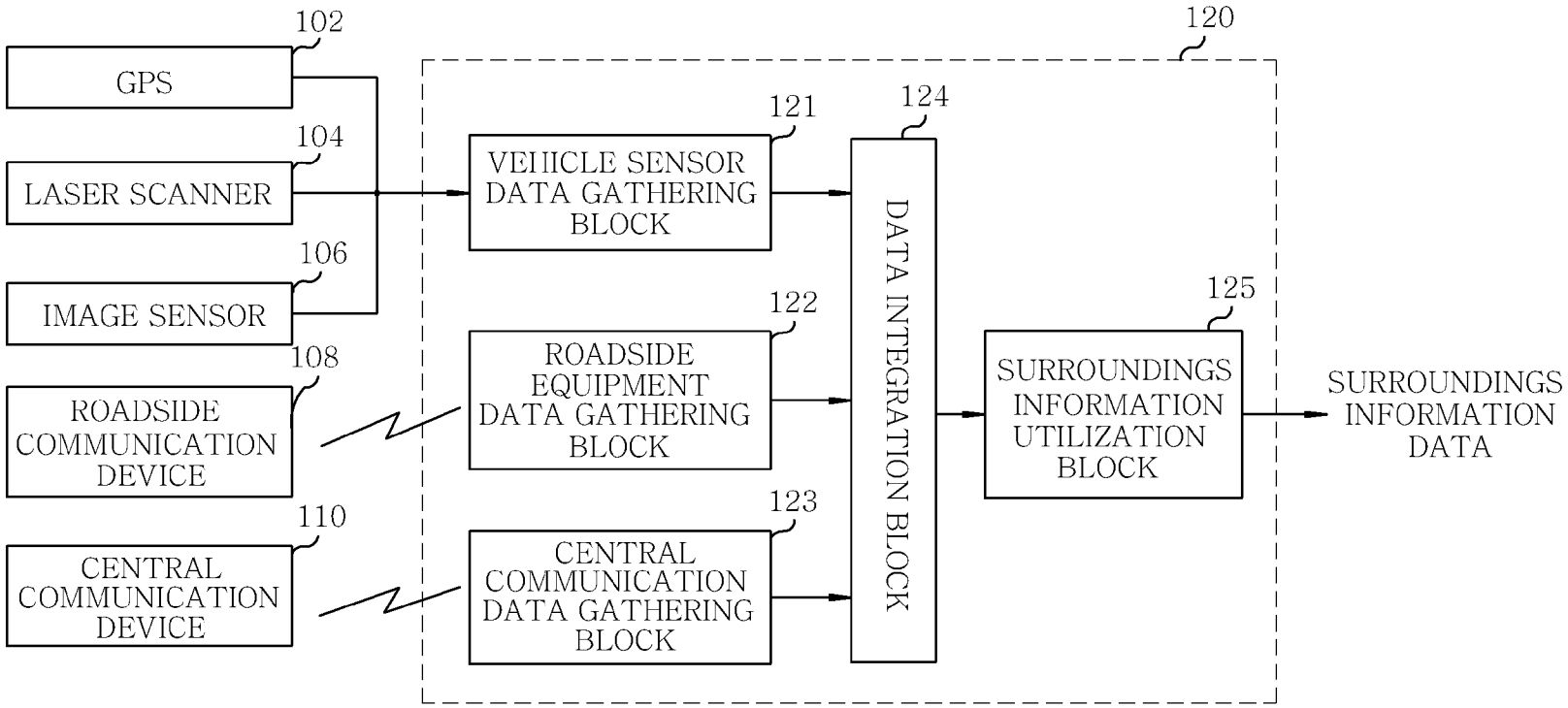
FIG. 1 is a block diagram of a system in which an apparatus for gathering information about the surroundings of a vehicle in accordance with an embodiment of the present invention is connected to sensors and devices for gathering information about surroundings through wired and wireless networks.

Hereinafter, exemplary embodiments of the present invention will be described below in more detail with reference to the accompanying drawings. The present invention may, however, be embodied in different forms, and should not be construed as being limited to the embodiments set forth herein. Rather, these embodiments are provided so that this disclosure will be thorough and complete, and will fully convey the scope of the present invention to those skilled in the art. Throughout the disclosure, like reference numerals refer to like parts throughout the various figures and embodiments of the present invention.

Furthermore, the terms described below have been defined by considering functions in embodiments of the present invention, and may be defined differently depending on a user or operator's intention or practice. Therefore, the definitions of such terms are based on the overall descriptions in the present specification.

Embodiment

FIG. 1 is a block diagram of a system in which an apparatus for gathering information about the surroundings of a vehicle in accordance with an embodiment of the present invention is connected to sensors and devices for gathering information about surroundings through wired and wireless networks. The apparatus 120 for gathering information about the surroundings of a vehicle includes a vehicle sensor data gathering block 121, a roadside equipment data gathering block 122, a central communication data gathering block 123, a data integration block 124, and a surroundings information utilization block 125.

Referring to FIG. 1, the vehicle sensor data gathering block 121 is configured to gather (or collect) information about the surroundings of a vehicle from one or more sensors mounted on the vehicle, for example, a GPS unit 102, a laser scanner 104, an image sensor 106 or the like, at a predetermined period, and provide the gathered information about the surroundings of the vehicle to the data integration block 124.

The roadside equipment data gathering block 122 is configured to gather (or collect) information about the surroundings of the vehicle from a roadside communication device installed on the driving infrastructure (for example, on and around the road) at a predetermined interval, and provide the gathered information to the data integration block 124. The roadside equipment data gathering block 122 may gather the information about the surroundings of the vehicle from a roadside communication device 108 through near field communication such as Bluetooth or WiFi.

For example, supposing that the roadside communication device 108 is installed in a traffic light of a crossroad, the roadside communication device 108 may periodically transmit the signal period of the traffic light, current signal information and the like through near field communication, and the roadside equipment data gathering block 122 may periodically receive the traffic light-related information transmitted in such a manner.

The central communication data gathering block 123 is configured to gather information about the surroundings of the vehicle from a remote central communication device 110 through wireless communication, such as the wireless Internet, at a predetermined period, and transmit the gathered information about surroundings to the data integration block 124. The information about surroundings may include the volume of traffic, whether or not an accident has occurred, and the like, and the central communication device 110 may include traffic information management equipment, such as a server installed in a traffic control center.

For this operation, the central communication data gathering block 123 wirelessly transmits vehicle information to the central communication device 110 and receives information about the surroundings of the corresponding vehicle from the central communication device 110. The vehicle information transmitted to the central communication device 110 may include information containing a vehicle ID, the vehicle position, the traveling direction, speed and the like.

The information about surroundings gathered through the vehicle sensor data gathering block 121, the roadside equipment data gathering block 122, and the central communication data gathering block 123 may include information about obstacles around the vehicle, information about signals around the vehicle, driver guide information about the driving infrastructure and the like. The information about obstacles around the vehicle may encompass obstacles, pedestrians, distances from surrounding vehicles and the like. The information about signals around the vehicle may encompass information about surrounding traffic light signals, information about signal transition periods of the traffic lights, crosswalk signal information, barricade signal information and the like. The driver guide information may include a road speed limit, a speed bump position, a road marker, a direction sign and the like.

The data integration block 124 is configured to classify the information about surroundings transmitted from the vehicle sensor data gathering block 121, the roadside equipment data gathering block 122, and the central communication data gathering block 123 for predefined data types, and integrate and manage the classified information about surroundings based on a preset reliability criterion. For this operation, the data integration block 124 may have the configuration illustrated in FIG. 2.

Figure 2:
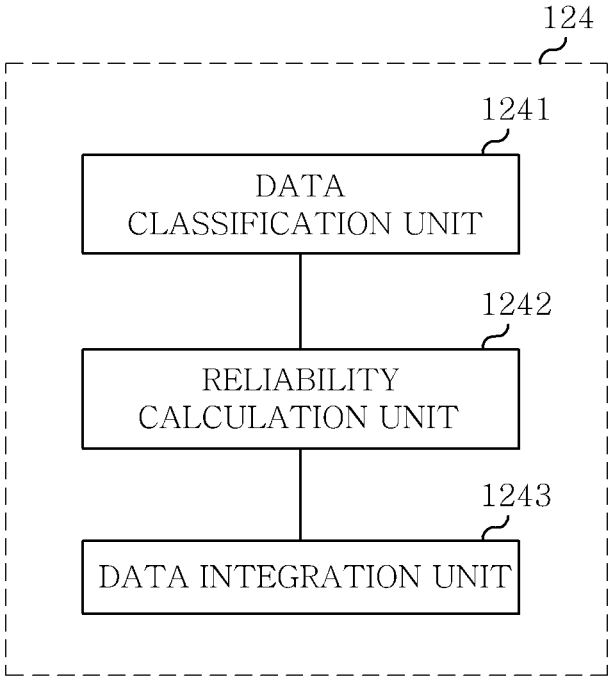
FIG. 2 is a detailed block diagram of a data integration block employed in the apparatus for gathering information about surroundings of a vehicle in accordance with the embodiment of the present invention.

FIG. 2 is a detailed block diagram of the data integration block 124 employed in the apparatus for gathering information about the surroundings of a vehicle in accordance with the embodiment of the present invention. The data integration block 124 may include a data classification unit 1241, a reliability calculation unit 1242, and a data integration unit 1243.

Referring to FIG. 2, the data classification unit 1241 is configured to classify the information about surroundings of the vehicle, transmitted from the vehicle sensor data gathering block 121, the roadside equipment data gathering block 122, and the central communication data gathering block 123, for the predefined data types.

The predefined data types may include information about obstacles around the vehicle, information about signals around the vehicle, and driver guidance information about the driving infrastructure. The information about obstacles around the vehicle may encompass obstacles, pedestrians, distances from surrounding vehicles and the like. The information about signals around the vehicle may include information about surrounding traffic light signals, crosswalk signals, barricade signals and the like. The driver guidance information may include speed limit information, speed bump position information, road marker information, directional sign information and the like.

The reliability calculation unit 1242 is configured to determine whether to integrate or delete the data classified for the respective types (the information about the surroundings of the vehicle) according to the preset reliability criterion. The determination is transmitted to the data integration unit 1243.

That is, the reliability calculation unit 1242 calculates the reliability of the data received from the vehicle sensor data gathering block 121, the roadside equipment data gathering block 122, and the central communication data gathering block 123, and may determine whether to delete or utilize the corresponding data according to the calculated reliability. In other words, the reliability calculation unit 1242 may decide to delete data whose reliability is lower than the preset reliability criterion. When the same type of data are contained in the information about surroundings gathered from respective data gathering blocks, the reliability calculation unit 1242 may select one of two or three kinds of information about surroundings as a single datum, depending on the type of the data.

The reliability calculation method may be changed depending on settings. In other words, the reliability calculation method may differ depending on the type of data and the gathering block used to gather the data. For example, in the case of A-type data (obstacle data), data acquired from the vehicle sensor data gathering block 121 using a laser scanner mounted on the vehicle may have higher reliability than data received from another data gathering block 122 or 123. Furthermore, in the case of B-type data (traffic light information), the highest reliability may be given to signal information gathered from the roadside communication device 108 by the roadside equipment data gathering block 122, the second highest reliability may be given to signal information gathered from the central communication device 110, and the lowest reliability may be given to signal information acquired from the image sensor mounted on the vehicle.

The data integration unit 1243 is configured to integrate or delete the related data according to the integration or deletion determination provided from the reliability calculation unit 1242.

That is, the data integration unit 1243 may integrate the information about surroundings gathered from different data gathering blocks into one datum. When the same type of information is gathered, the data integration unit 1242 may integrate the information into one data type, even though the information was gathered from different data gathering blocks. For example, information on distances from surrounding vehicles may be gathered by the laser scanner 104, and information on positions of the surrounding vehicles may be transmitted through the central communication device 110. Since the two pieces of information comprise the same type of data, they may be integrated as one datum. Furthermore, the data integration unit 1243 may be set to integrate only data whose reliability meets or exceeds some predetermined reliability threshold according to the preset reliability criterion.

Referring to FIG. 1, the surroundings information utilization block 125 is configured to utilize the integrated managed information about surroundings. The utilization of the information about surroundings may include automatic control for a vehicle, output control to a vehicle terminal, broadcasting to surrounding vehicles and the like.

That is, the surroundings information utilization block 125 may apply the integrated managed information about surroundings to the automatic control for the vehicle when functioning as an automatic vehicle controller. Furthermore, the surroundings information utilization block 125, when functioning as a terminal output controller, may output the integrated managed information about surroundings as an image or voice through the vehicle terminal such that a driver recognizes integrated managed information about surroundings. Furthermore, the surroundings information utilization block 125 broadcasts the integrated managed information about surroundings to surrounding vehicles on the driving infrastructure (road) when functioning as a broadcasting output controller. The information about surroundings may be broadcast through near field communication or the like.

In this embodiment of the present invention, it has been described that three data gathering blocks, including the vehicle sensor data gathering block, the roadside equipment data gathering block, and the central communication data gathering block are used as the unit for gathering information about the surroundings of the vehicle. However, this is only an example for convenience and understanding of description, and the present invention is not limited thereto. That is, two data gathering blocks, including the vehicle sensor data gathering block and the roadside equipment data gathering block, may be applied (utilized) as the surroundings information gathering unit, or two data gathering blocks including the vehicle sensor data gathering block and the central communication data gathering block may be applied as the surroundings information gathering unit.

In accordance with the embodiment of the present invention, information about the surroundings of a vehicle is gathered from one or more sensors mounted on the vehicle, information about the surroundings of the vehicle is gathered from a roadside communication device and/or a central communication device, the gathered information about surroundings is classified for the predefined data types, and the classified information about surroundings is integrated and managed based on the preset reliability criterion. Therefore, the information about the surroundings of the vehicle may be reliably gathered, and may be effectively utilized for vehicle operation.

Meanwhile, combinations of the respective blocks of the accompanying block diagrams may be executed using computer program instructions. Since the computer program instructions may be mounted in general computers, special computers or processors of programmable data processing equipment, the instructions executed through the computers or processors of other programmable data processing equipment generate units to perform the functions described in the respective blocks of the block diagrams. Since the computer program instructions may be stored in a computer-usable or computer-readable memory oriented to computers or other programmable data processing equipment in order to implement functions in a specific method, the instructions stored in the computer-usable or computer-readable memory may be used to manufacture products containing instruction units to perform the functions described in the respective blocks of the block diagrams. Since the computer program instructions may be mounted in computers or other programmable data processing equipment, instructions which perform a series of operation steps on the computers or other programmable data processing equipment to generate processes executed by the computers and operate the computers or other programmable data processing equipment may provide steps for performing the functions described in the respective blocks of the block diagram.

Furthermore, each of the blocks may indicate a part of a module, a segment or a code including one or more executable instructions for executing specific logical functions. Furthermore, in some alternative embodiments, the functions described in the blocks may be performed in some other sequence. For example, the functions of two successive blocks may be performed substantially at the same time, or may be performed in reverse order depending on the corresponding functions.

While the invention has been shown and described with respect to the preferred embodiments, the present invention is not limited thereto. It will be understood by those skilled in the art that various changes and modifications may be made without departing from the scope of the invention as defined in the following claims.

What is claimed is:

1. An apparatus for gathering information about surroundings of a vehicle, comprising:

a vehicle sensor data collector configured to gather first information about surroundings of the vehicle from one or more sensors mounted on the vehicle;

a roadside equipment data collector configured to gather second information about surroundings of the vehicle from a roadside communication device installed on a driving infrastructure;

a processor for data integration configured:

to classify the first information about surroundings and the second information about surroundings for predefined data types, determine whether or not to integrate the classified first information or the classified second information based on a preset reliability criterion, and integrate or delete the classified first information or the classified second information based on the determination of whether or not to integrate the classified first information or the classified second information, wherein the processor for data integration decides to delete the classified first information or the classified second information having a lower reliability than the preset reliability criterion; and an automatic vehicle controller configured to utilize the integrated managed information about surroundings, wherein the automatic vehicle controller applies the integrated managed information about the surroundings to automate control for the vehicle.

2. The apparatus of claim 1, wherein the vehicle sensor data collector and the roadside equipment data collector gather the first information about surroundings and the second information about surroundings, respectively, at a predetermined interval.

3. The apparatus of claim 1, wherein the predefined data types comprise one or more of obstacle data around the vehicle, signal data around the vehicle, and driver guide data on the driving infrastructure.

4. The apparatus of claim 1, wherein when the first information about surroundings and the second information about surroundings contain the same type of data, the reliability calculation unit accepts data of the first information about surroundings or the second information about surroundings as one integrated datum, depending on the type of data.

5. The apparatus of claim 1, wherein the automatic vehicle controller further comprises a terminal output controller to output the integrated managed information about surroundings through a vehicle terminal.

6. The apparatus of claim 1, wherein the automatic vehicle controller further comprises a broadcasting output controller to broadcast the integrated managed information about surroundings to surrounding vehicles on the driving infrastructure.

7. An apparatus for gathering information about surroundings of a vehicle, comprising:

a vehicle sensor data collector configured to gather first information about surroundings of the vehicle from one or more sensors mounted on the vehicle;

a central communication data collector configured to gather second information about surroundings of the vehicle from a remote central communication device through wireless communication;

a processor for data integration configured:

to classify the first information about surroundings and the second information about surroundings for predefined data types, determine whether or not to integrate the classified first information or the classified second information based on a preset reliability criterion, and integrate or delete the classified first information or the classified second information based on the determination of whether or not to integrate the classified first information or the classified second information, wherein the processor for data integration decides to delete the classified first information or the classified second information having a lower reliability than the preset reliability criterion; and an automatic vehicle controller configured to utilize the integrated managed information about surroundings, wherein the automatic vehicle controller applies the integrated managed information about the surroundings to automate control for the vehicle.

8. The apparatus of claim 7, wherein the vehicle sensor data collector and the central communication data collector gather the first information about surroundings and the second information about surroundings, respectively, at a predetermined interval.

9. The apparatus of claim 7, wherein the predefined data types comprise one or more of obstacle data around the vehicle, signal data around the vehicle, and driver guide data on the driving infrastructure.

10. The apparatus of claim 7, wherein when the first information about surroundings and the second information about surroundings contain the same type of data, the reliability calculation unit accepts data of the first information about surroundings or the second information about surroundings as one integrated datum, depending on the type of data.

11. The apparatus of claim 7, wherein the automatic vehicle controller further comprises a terminal output controller to output the integrated managed information about surroundings through a vehicle terminal.

12. An apparatus for gathering information about surroundings of a vehicle, comprising:

a vehicle sensor data collector configured to gather first information about surroundings of the vehicle from one or more sensors mounted on the vehicle;

a roadside equipment data collector configured to gather second information about surroundings of the vehicle from a roadside communication device installed on a driving infrastructure;

a central communication data collector configured to gather third information about surroundings of the vehicle from a remote central communication device through wireless communication; and a processor for data integration configured to:

classify the first information about surroundings, the second information about surroundings, and the third information about surroundings for predefined data types, determine whether or not to integrate the classified first information, the classified second information, or the classified third information based on a preset reliability criterion, and integrate or delete the classified first information, the classified second information, or the classified third information based on the determination of whether or not to integrate the classified first information, the classified second information, or the classified third information, wherein the processor for data integration decides to delete the classified first information, the classified second information, or the third information having a lower reliability than the preset reliability criterion; and an automatic vehicle controller configured to utilize the integrated managed information about surroundings, wherein the automatic vehicle controller applies the integrated managed information about the surroundings to automate control for the vehicle.

* * * * *